US010513882B2

(12) United States Patent
Cheng

(10) Patent No.: US 10,513,882 B2
(45) Date of Patent: Dec. 24, 2019

(54) CURTAIN REEL STRUCTURE FOR RAPIDLY POSITIONING AND LOCKING

(71) Applicant: CHEN TIAN CO., LTD., Tainan (TW)

(72) Inventor: Ching-Hsiang Cheng, Tainan (TW)

(73) Assignee: Chen Tian Co., Ltd., Tainan (TW)

( * ) Notice: Subject to any disclaimer, the term of this patent is extended or adjusted under 35 U.S.C. 154(b) by 53 days.

(21) Appl. No.: 15/983,268

(22) Filed: May 18, 2018

(65) Prior Publication Data

US 2019/0218855 A1 Jul. 18, 2019

(30) Foreign Application Priority Data

Jan. 18, 2018 (TW) ..... 107101875 A

(51) Int. Cl.
*E06B 9/24* (2006.01)
*B65H 75/44* (2006.01)

(52) U.S. Cl.
CPC ..... *E06B 9/24* (2013.01); *B65H 75/4431* (2013.01)

(58) Field of Classification Search
CPC .... E06B 9/24; E06B 9/322; E06B 2009/3225; B65H 75/4431
See application file for complete search history.

(56) References Cited

U.S. PATENT DOCUMENTS

2010/0147470 A1* 6/2010 Wong ..... E06B 9/322 160/370
2014/0083630 A1* 3/2014 Wu ..... E06B 9/322 160/84.04
2016/0208551 A1* 7/2016 Huang ..... E06B 9/60
2018/0155981 A1* 6/2018 Guerra ..... E06B 9/322

FOREIGN PATENT DOCUMENTS

TW M467416 U 12/2013
TW M469013 U 1/2014
TW M531219 U 11/2016

* cited by examiner

*Primary Examiner* — Sang K Kim
(74) *Attorney, Agent, or Firm* — Rosenberg, Klein & Lee

(57) ABSTRACT

A curtain reel structure for rapidly positioning and locking is disclosed herein. It mainly comprises a winding spool, a reel seat for an assembly of the winding spool and having a neck part, a removable lock element pivotally connected to the neck part of the reel seat, and a flexible member engaged with the neck part of the reel seat. The removable lock element pivots to change direction and contacts the flexible member to lift and lower the flexible member.

5 Claims, 10 Drawing Sheets

CURTAIN REEL STRUCTURE FOR RAPIDLY POSITIONING AND LOCKING

BACKGROUND OF THE INVENTION

1. Field of the Invention

The present invention relates to a curtain reel structure for rapidly positioning and locking which comprises a flexible member for resilient support to achieve effects of rapid positioning and locking a reel seat.

2. Description of Related Art

Generally, in assembly of a curtain, a plurality of reel rotors are inserted by a revolving rod for connection. Each of the reel rotors comprises a roller seat and a reel. The reel is provided with a hole for an insertion of the revolving rod so that the reel can be engaged with and accommodated in the roller seat. After one reel rotor is assembled, the revolving rod also rotates with the rotation of the reel in the roller seat. As a result, when the rest of the reel rotors are required to be assembled, the reel rotors could not be accurately aligned to keep the reel rotors in the same direction, resulting in an inconsistent positions of different reel rotors. In this way, it is necessary to disassemble and reassemble the reel rotors, making the assembly process complicated and time-consuming.

Accordingly, some curtain reel structures are developed to solve the above-mentioned problem. For instance, a Taiwan Patent No. TWM467416 (U), issued on 11 Dec. 2013, a Taiwan Patent No. TWM469013 (U), issued on 1 Jan. 2014, and a Taiwan Patent No. TWM531219 (U), issued on 1 Nov. 2016, have disclosed curtain reel structures whose reel seats can be effectively positioned when embedded in curtain rails. However, both structures of the Taiwan Patent No. TWM467416 (U) and TWM531219 (U) use an inserting piece to correspondingly insert the roller seat and the reel for fixing the reel on the revolving rod and use a knob or a locking piece to secure the roller seat on the curtain rail. In actual assembly, it is inconvenient to simultaneously position the revolving rod and screw the locking piece to the roller seat.

SUMMARY OF THE INVENTION

Therefore, in view of the above-mentioned problems, the aspect of the present invention is to provide a curtain reel structure for rapidly positioning and locking which comprises a flexible member for resilient support to achieve effects of rapid positioning and locking a reel seat.

Disclosed herein is a curtain reel structure for rapidly positioning and locking. It mainly comprises a winding spool, a reel seat for an assembly of the winding spool and having a neck part, a removable lock element pivotally connected to one side of the neck part of the reel seat, and a flexible member engaged at the other side the neck part of the reel seat. The removable lock element can pivot to change direction so as to affect the lifting and lowering position of the flexible member.

Accordingly, the reel seat can be locked within the curtain rail via the lift of the flexible member and fasten on an inner wall of the curtain rail so as to achieve efficacy of rapidly positioning and locking.

DETAILED DESCRIPTION OF THE PREFERRED EMBODIMENT

Hereinafter, an exemplary embodiment of the present invention is will be described in detail with reference to the accompanying drawings.

Figure 1:
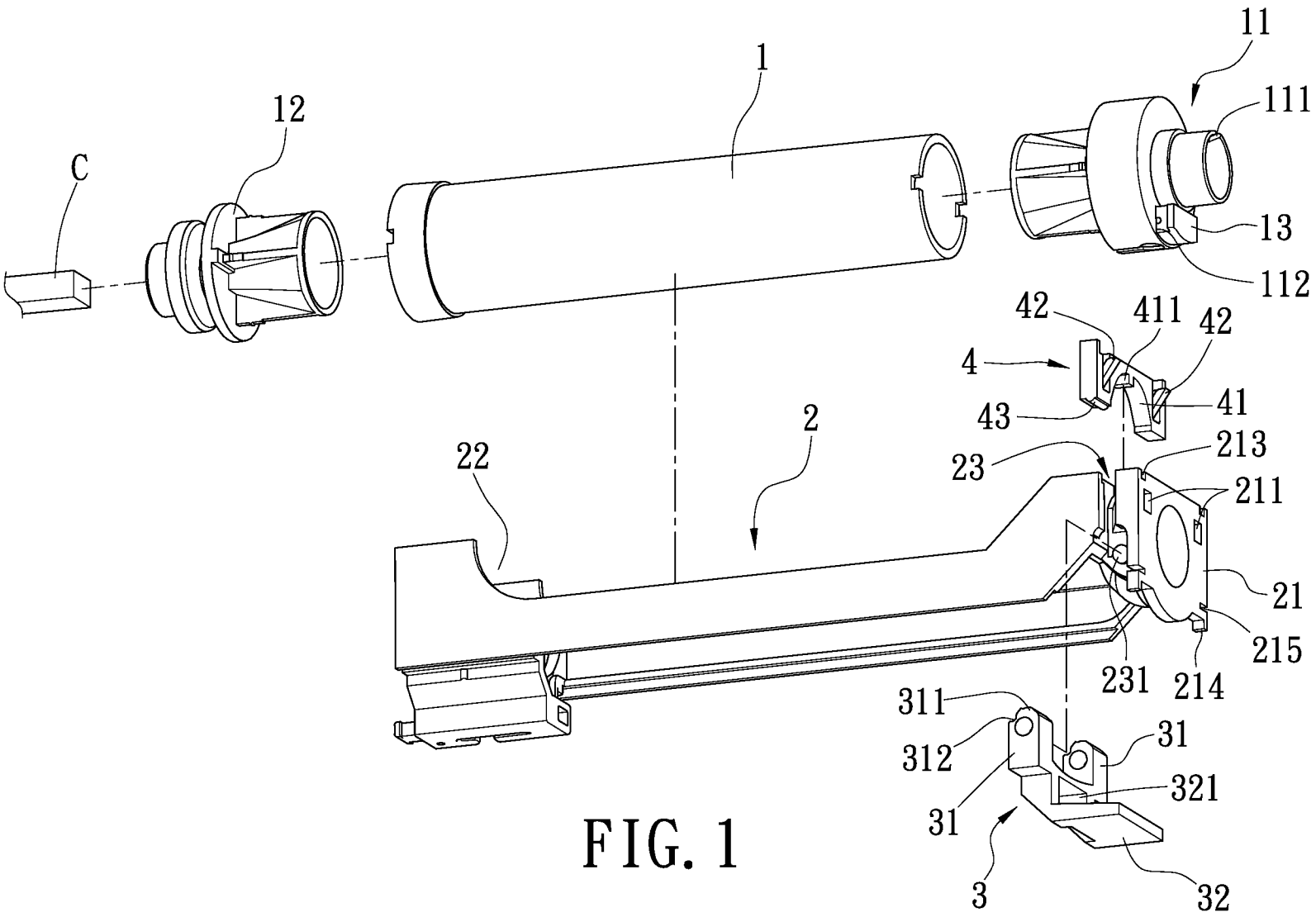
FIG. 1 is an explosion diagram showing a curtain reel structure for rapidly positioning and locking according to the present invention.
Figure 2:
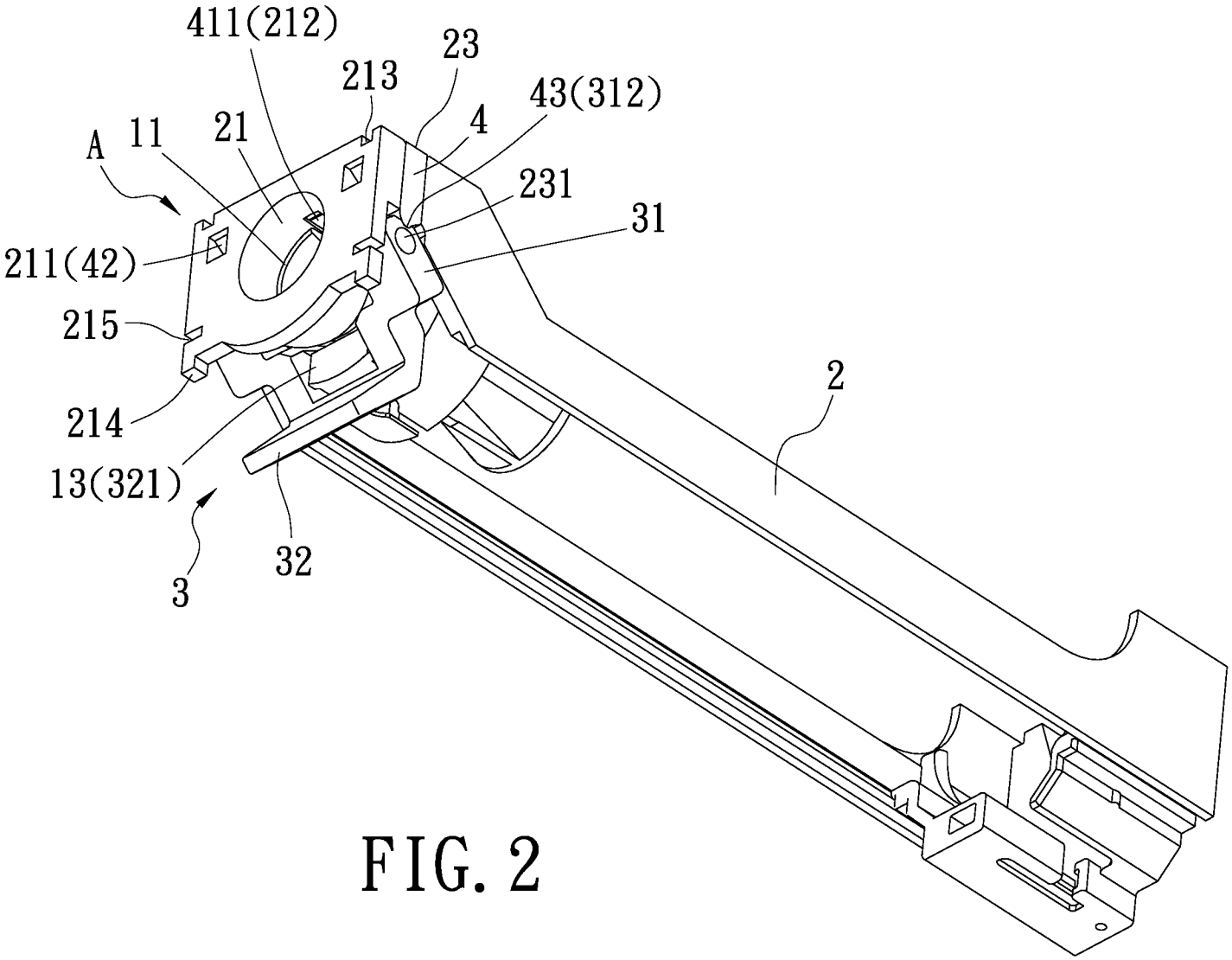
FIG. 2 is a schematic diagram showing a curtain reel structure for rapidly positioning and locking in assembly according to the present invention.
Figure 3:
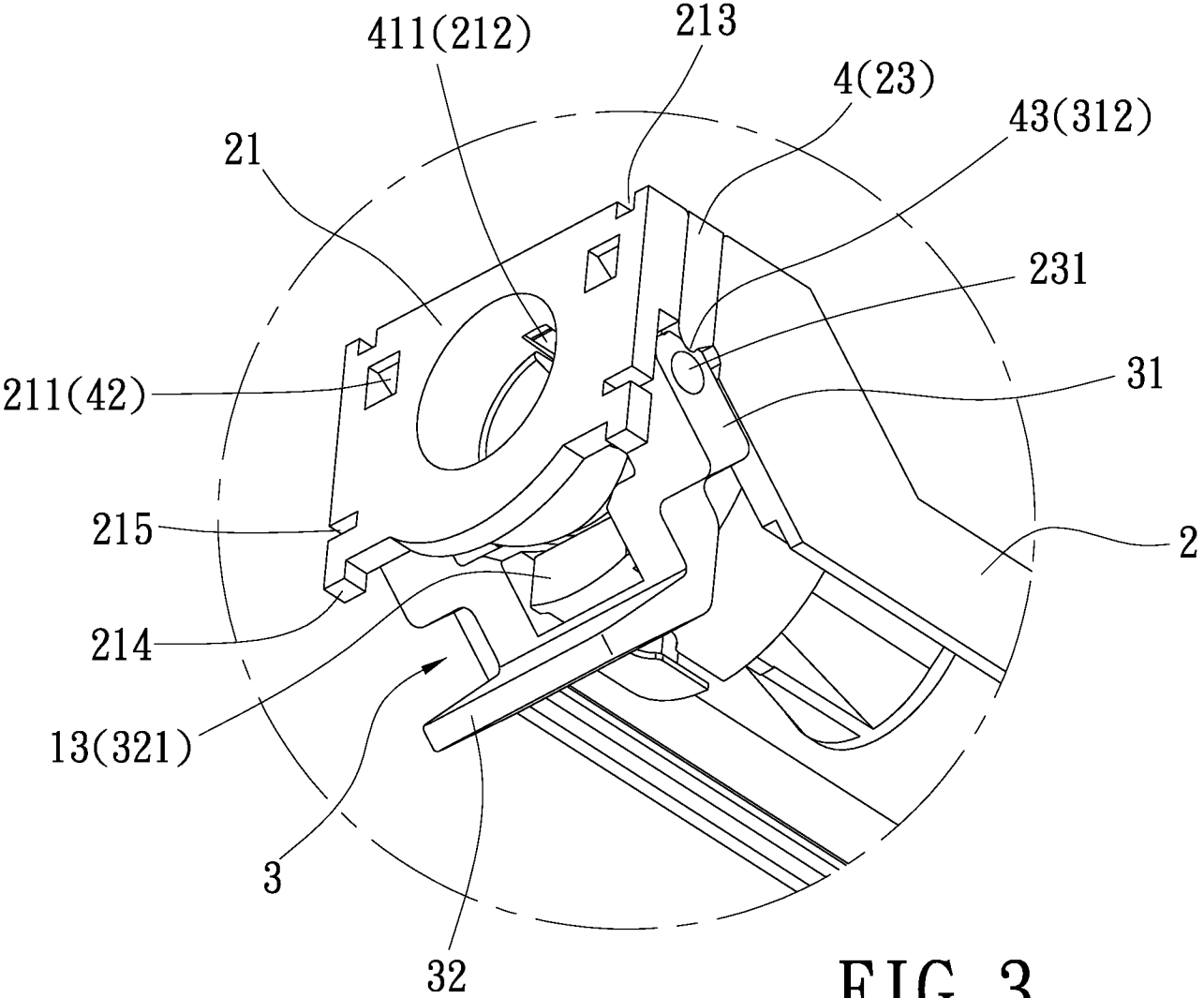
FIG. 3 is a partial enlarged view showing a reel seat, a removable lock element, and a flexible member in assembly according to the present invention.
Figure 4:
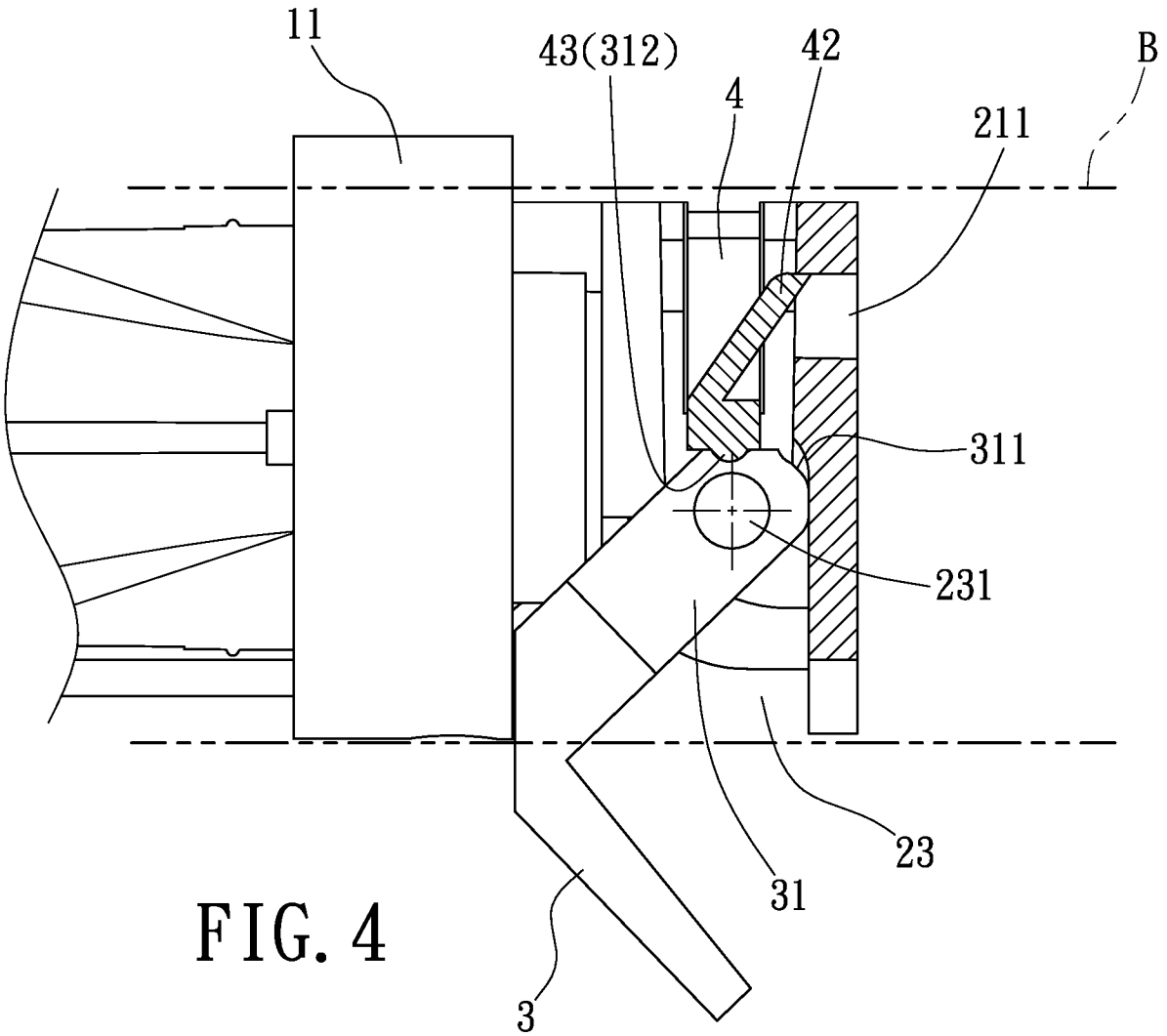
FIG. 4 is a cross-sectional view showing a flexible member in assembly and positioning according to the present invention.
Figure 5:
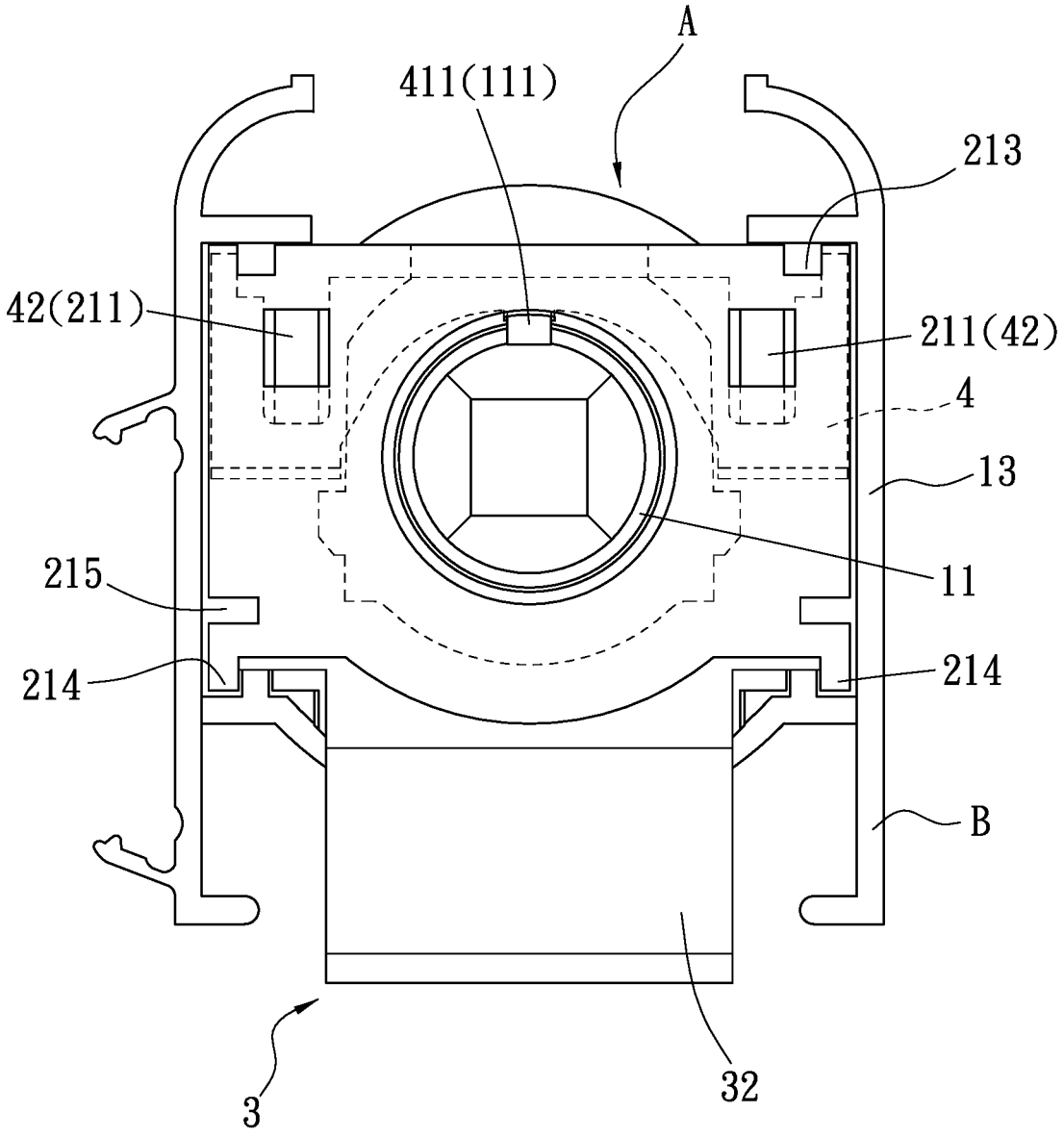
FIG. 5 is a lateral perspective view of showing a flexible member in assembly and positioning according to the present invention.
Figure 6:
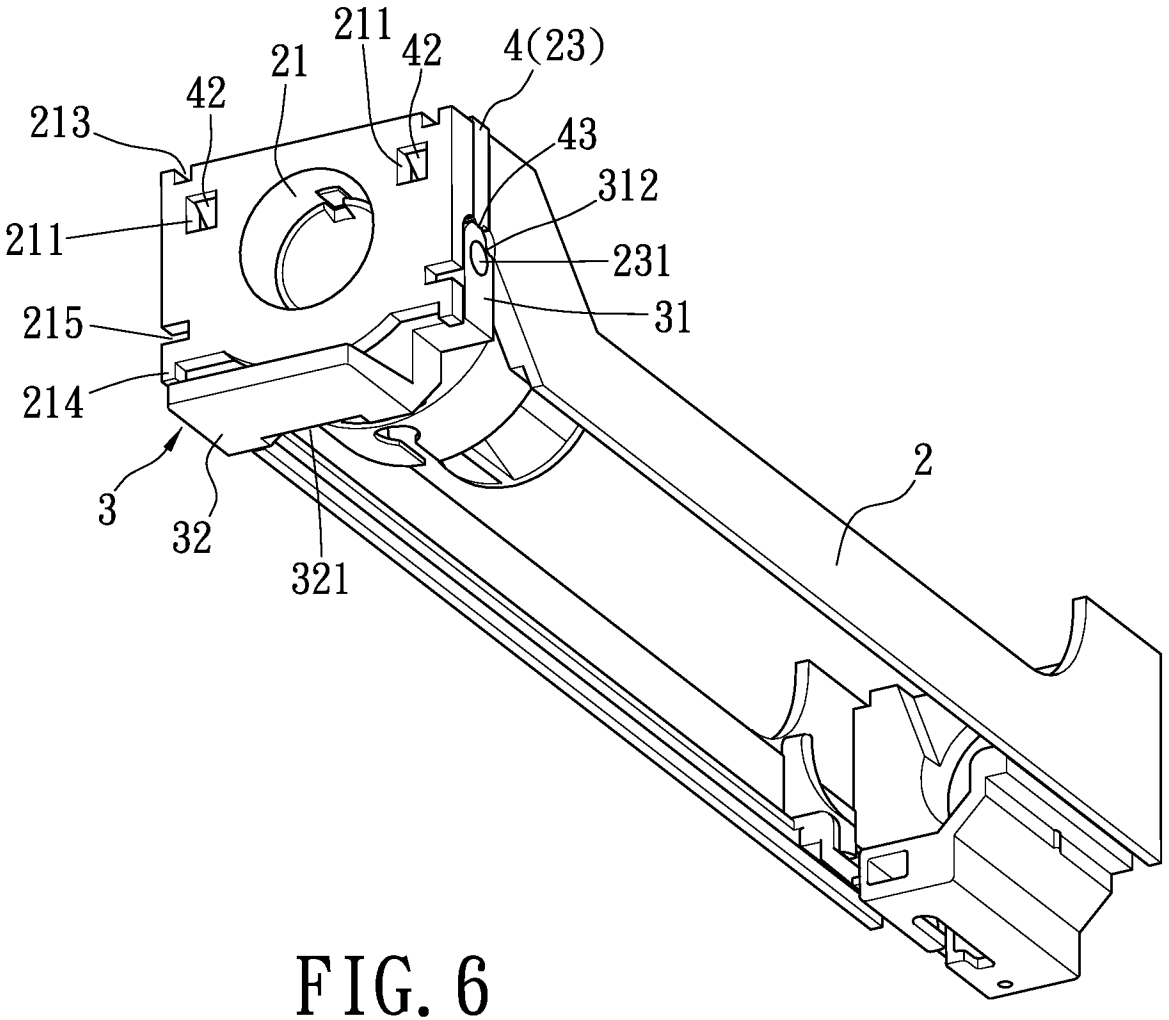
FIG. 6 is a schematic diagram showing a removable lock element in a rotating state according to the present invention.

Referring to FIG. 1, FIG. 2 and FIG. 4, a curtain reel structure for rapidly positioning and locking of the present invention is disclosed herein. It mainly comprises at least one reel device (A) for engaging in a curtain rail (B).

Each of the at least one reel device (A) comprises a winding spool (1), a reel seat (2), a removable lock element (3), and a flexible member (4).

The winding spool (1) is provided with a first axial part (11) and a second axial part (12) opposite to the first axial part (11) for winding a string.

The reel seat (2) is provided with a first engaging part (21) and a second engaging part (22) opposite to the first engaging part (21) for respectively engagement with the first axial part (11) and the second axial part (12) of the winding spool (1), and a neck part (23) disposed at a first side surface of the first engaging part (21). The first engaging part (21) is provided with two locking slots (211) on its second side surface for communicating with the neck part (23), and the neck part (23) is provided with a pivot member (231) on its one side.

The removable lock element (3) is pivotally connected to the pivot member (231) and provided with two pivot ears (31) at its one end for correspondingly assembling to the pivot member (231). The two pivot ears (31) are further provided with at least one annular pushing portion (311) and at least one recess (312) on the at least one annular pushing portion (311).

The flexible member (4) is engaged at the other side of the neck part (23) and provided with an inner annular portion (41) to sleeve on the neck part (23), two flexible sheets (42) corresponding to the two locking slots (211) for engaging with the two locking slots (211), and at least one protrusion (43) corresponding to the at least one annular pushing portion (311) or the at least one recess (312) on the two pivot ears (31) for being supported by the at least one annular pushing portion (311) or engaging with the at least one recess (312) of the removable lock element (3) so as to allow the flexible member (4) to be in the neck part (23) or out of the neck part (23) to push against an inner wall of the curtain rail (B), respectively.

Referring to FIG. 1 to FIG. 5, the reel device (A) must be completely assembled before it is embedded in the curtain rail (B). The assembly of the reel device (A) includes: assembling the winding spool (1) to the reel seat (2) by engaging the first axial part (11) and the second axial part (12) with the first engaging part (21) and the second engaging part (22); pivotally connecting the pivot member (231) on one side of the neck part (23) at the first side surface of the first engaging part (21) to the removable lock element (3); assembling the two pivot ears (31) of the removable lock element (3) to the pivot member (231), the two pivot ears (31) having at least one recess (312) at their top; and engaging the flexible member (4) at the other side of the neck part (23) by correspondingly engaging the two flexible sheets (42) with the two locking slots (211) of the first engaging part (21) and correspondingly engaging the at least one protrusion (43) with the at least one recess (312) on the two pivot ears (31) simultaneously so as to assembly and position the flexible member (4) and the removable lock element (3) on the reel seat (2) and complete the assembly of the reel device (A).

To increase positioning and locking effects between the winding spool (1) and the flexible member (4), a rib (411) is further provided on the inner annular portion (41). The neck part (23) at the first engaging part (21) and a wall of the first axial part (11) are respectively provided with a first slot (212) corresponding to the rib (411) and a second slot (111) corresponding to the rib (411) so as to correspondingly embed the rib (411) in the first slot (212) of the first engaging part (21) and the second slot (111) of the first axial part (11) and achieve the positioning effect of locking the position of the first axial part (11) by 90 degrees. In such a case, it is easy to pass a driving rod (C) in a center of the winding spool (1), which helps to easily and quickly assemble plural reel devices (A) to an appropriate position on the curtain rail (B) and prevent arbitrary rotation of the winding spool (1).

Figure 10:
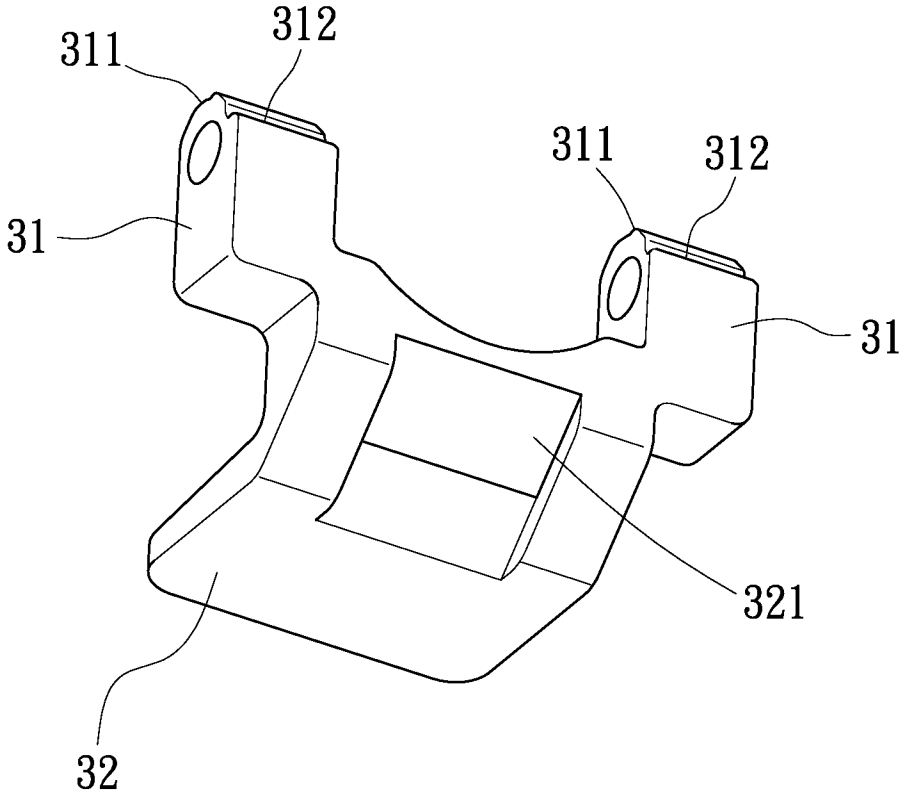
FIG. 10 is a stereogram showing a removable lock element according to the present invention.

Referring to FIG. 10, a stereogram showing a removable lock element according to the present invention is revealed. The other end of the removable lock element (3) is provided with a buckle (32) for turning the removable lock element (3), and the buckle (32) is further provided with a slot hole (321). The first axial part (11) of the winding spool (1) is provided with a chamber (112) and a sliding seat (13) inserted in the chamber (112) to clamp the string and thread through the slot hole (321) for rapidly positioning. In practical use, after the winding spool (1) is placed in the reel seat (2), a front end of the sliding seat (13) is inserted into the chamber (112) of the first axial part (11), and a rear end of the sliding seat (13) is correspondingly inserted into the slot hole (321) of the removable lock element (3), so that the winding spool (1) is positioned at a positive 90 degrees and the first axial part (11) of the winding spool (1) is locked simultaneously. It can be learned that during the assembly of the relevant elements of the reel device (A), the slot hole (321) of the removable lock element (3) is engaged with the rear end of the sliding seat (13) to position and lock the winding spool (1), and then the flexible member (4) is engaged with the other side of the neck part (23). At the same time, the rib (411) of the flexible member (4) can be directly inserted into the first slot (212) of the neck part (23) and pivotally connected to the second slot (111) of the first axial part (11) without aligning with the winding spool (1). Accordingly, the winding spool (1) is positioned by the dual positioning method described above, so the flexible member (4) and the removable lock element (3) can be assembled and positioned on the reel seat (2).

Referring to FIG. 6 to FIG. 9, after assembled, the reel device (A) is engaged in the curtain rail (B). Since the flexible member (4) in the reel device (A) is embedded in the neck part (23) and has the same height as the first engaging part (21), the reel device (A) can be smoothly embedded in the curtain rail (B). The position of the reel device (A) is further set according to the curtain. In positioning the reel device (A), the removable lock element (3) is rotated upwards, so the pivot ears (31) rotate around the pivot member (231) as a center of rotation. The change of the angle of the pivot ears (31) causes the at least one recess (312) to disengage from the at least one protrusion (43) at a bottom edge of the flexible member (4) and allow the at least one annular pushing portion (311) to support the at least one protrusion (43), so the flexible member (4) is lifted upwards. Although the flexible member (4) is lifted upwards, it is still assembled and positioned in the neck part (23) due to deformation of the flexible sheets (42) and continuously engagement of the flexible sheets (42) with the locking slots (211). After the flexible member (4) is lifted upwards, a top edge of the flexible member (4) pushes against the inner wall of the curtain rail (B), which achieves the effect of positioning the reel device (A) on the curtain rail (B). Additionally, when the flexible member (4) is lifted upwards, the rib (411) of the inner annular portion (41) is detached from the second slot (111) of the first axial part (11) but not separated from the first slot (212) of the first engaging part (21). In such a case, detachment of the first axial part (11) of the winding spool (1) allows the user to pull the string to control the lifting and lowering of the curtain.

Figure 7:
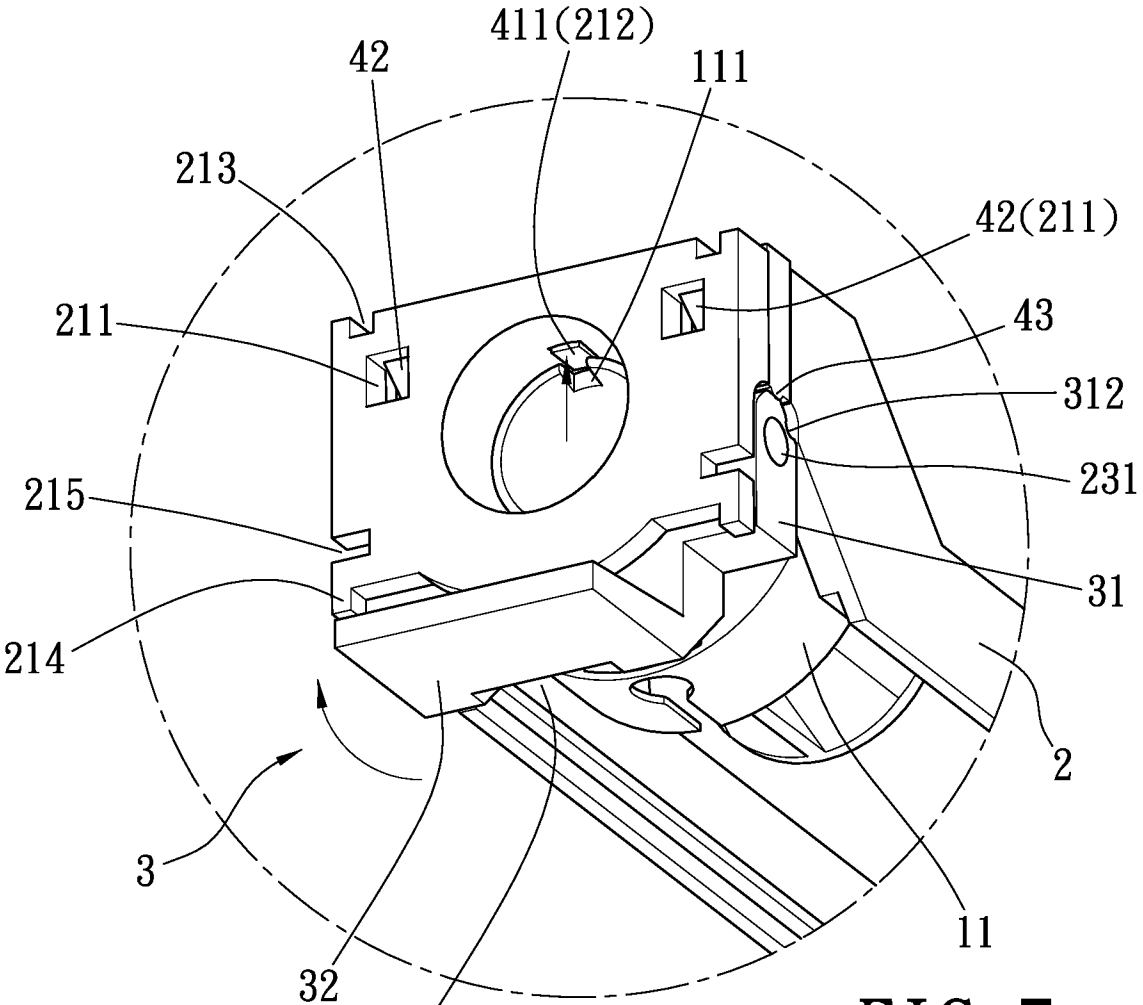
FIG. 7 is a partial enlarged view showing a removable lock element in a rotating state according to the present invention.
Figure 8:
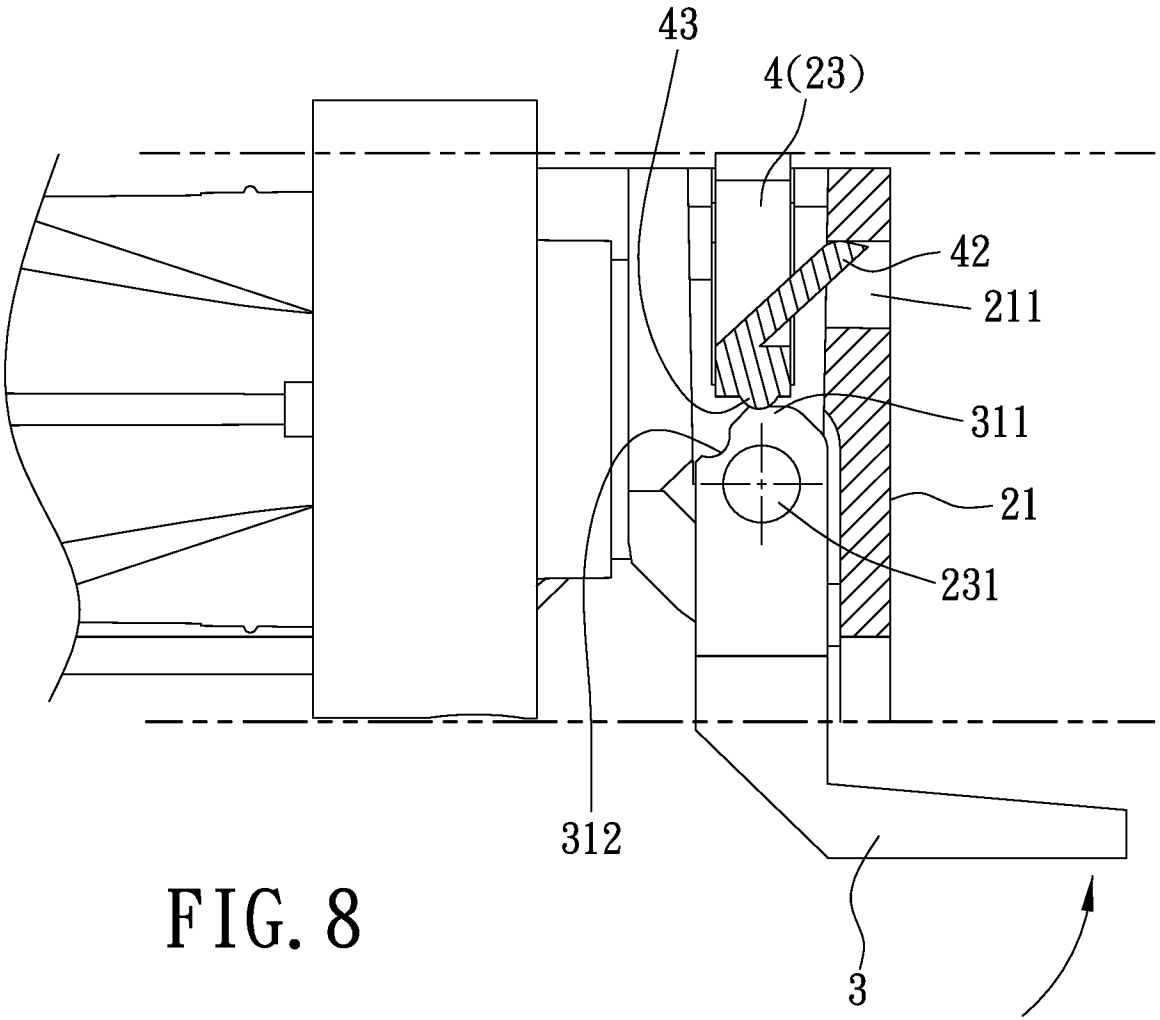
FIG. 8 is a cross-sectional view showing a flexible member being pushed out against a curtain rail.
Figure 9:
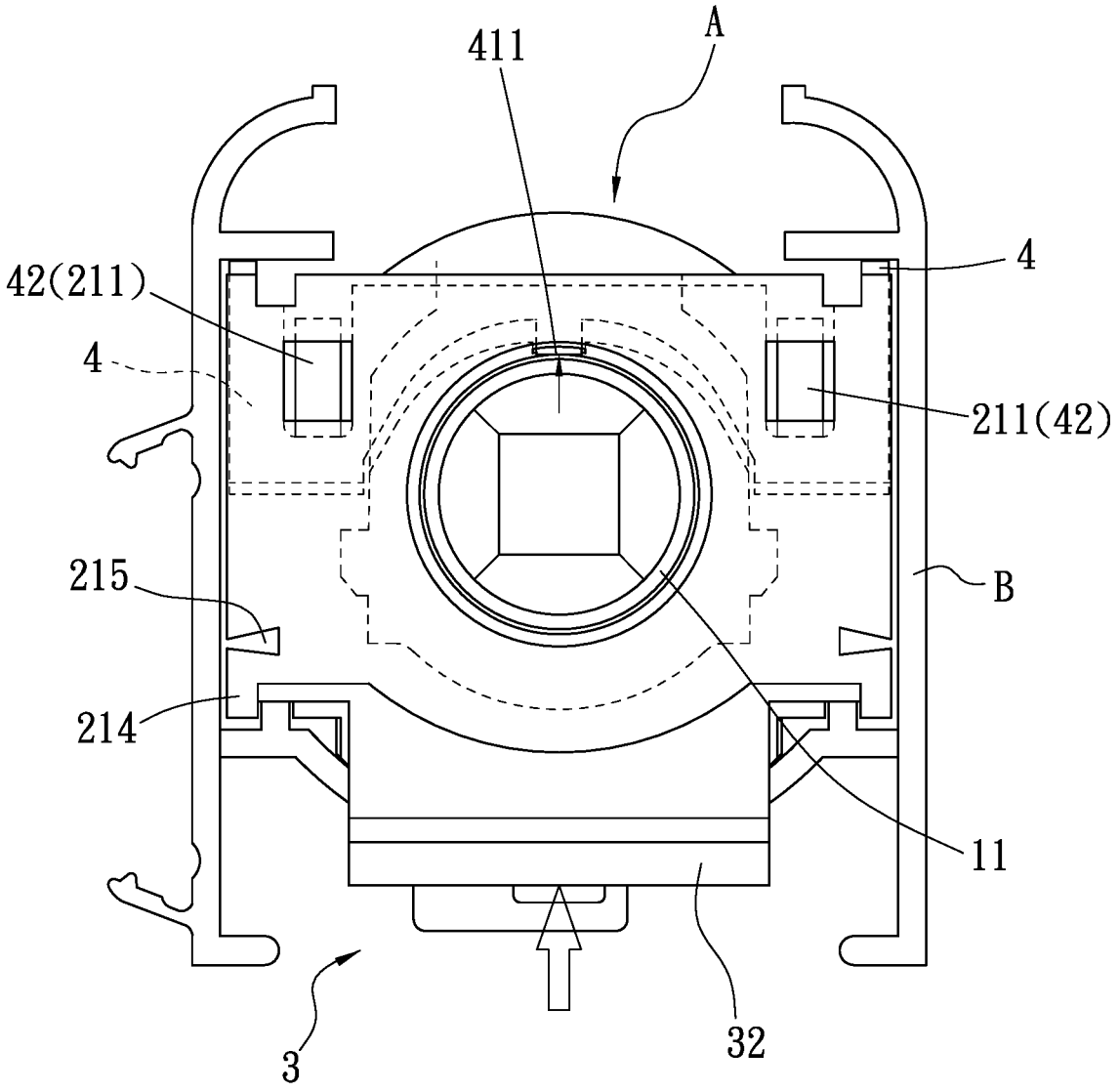
FIG. 9 is a lateral perspective view of showing a flexible member being pushed out against the curtain rail.

Referring to FIG. 7, a top edge of the first engaging part (21) is provided with two grooves (213) corresponding to the curtain rail (B) for positioning, and a bottom edge of the second side surface of the first engaging part (21) is provided with two convex blocks (214) to push against the inner wall of the curtain rail (B). When the removable lock element (3) is actuated to rotate, the pivot ears (31) push against the second side surface of the first engaging part (21). Furthermore, the second side surface of the first engaging part (21) is provided with two elastic slots (215) corresponding to the two pivot ears (31) so as to reduce the contact pressure against the two pivot ears (31).

According to the above description, in comparison with the traditional technique, a curtain controller assembly structure according to the present invention has the advantages as following:

1. The present invention uses the removable lock element to control the lifting and lowering of the flexible member so that the reel seat can be positioned in the inner wall of the curtain rail by lift of the flexible member so as to achieve effects of rapid positioning and locking the reel seat.

2. The present invention effectively controls the winding spool to lock in the reel seat or release from the reel seat for use by engagement of the rib of the flexible member with the first slot and the second slot or by detachment of the rib from the second slot.

What is claimed is:

1. A curtain reel structure for rapidly positioning and locking, comprising at least one reel device for engaging in a curtain rail, each of the at least one reel device comprising:

a winding spool having a first axial part and a second axial part opposite to the first axial part for winding a string;

a reel seat having a first engaging part, a second engaging part opposite to the first engaging part for respectively engagement with the first axial part and the second axial part of the winding spool, and a neck part disposed at a first side surface of the first engaging part, wherein the first engaging part is provided with two locking slots on a second side surface thereof for communicating with the neck part, and wherein the neck part is provided with a pivot member on one side thereof;

a removable lock element pivotally connected to the pivot member and having two pivot ears at one end thereof for correspondingly assembling to the pivot member, wherein the two pivot ears is provided with at least one annular pushing portion and at least one recess on the at least one annular pushing portion;

a flexible member engaged at the other side of the neck part and having an inner annular portion to sleeve on the neck part, two flexible sheets corresponding to the two locking slots for engaging with the two locking slots, and at least one protrusion corresponding to the at least one annular pushing portion or the at least one recess of the two pivot ears for being supported by the at least one annular pushing portion or engaging with the at least one recess of the removable lock element so as to allow the flexible member to be in the neck part or out of the neck part, respectively.

2. The curtain reel structure for rapidly positioning and locking as claimed in claim 1, wherein the inner annular portion of the flexible member is provided with a rib, and wherein the neck part at the first engaging part and a wall of the first axial part are respectively provided with a first slot corresponding to the rib and a second slot corresponding to the rib so as to correspondingly embed the rib in the first slot and the second slot or separate the rib from the second slot.

3. The curtain reel structure for rapidly positioning and locking as claimed in claim 1, wherein the other end of the removable lock element is provided with a buckle for turning the removable lock element and having a slot hole, and wherein the first axial part of the winding spool is provided with a chamber and a sliding seat for inserting into the chamber to clamp the string and thread through the slot hole for positioning.

4. The curtain reel structure for rapidly positioning and locking as claimed in claim 1, wherein the second side surface of the first engaging part is provided with two elastic slots corresponding to the two pivot ears to reduce the contact pressure against the two pivot ears.

5. The curtain reel structure for rapidly positioning and locking as claimed in claim 1, wherein a bottom edge of the second side surface of the first engaging part is provided with two convex blocks to push against an inner wall of the curtain rail.

* * * * *